US008025973B2

(12) United States Patent
Rudolph et al.

(10) Patent No.: US 8,025,973 B2
(45) Date of Patent: Sep. 27, 2011

(54) PAPER SUBSTRATE CONTAINING A FLUORINE CONTAINING COMPOUND AND HAVING ENHANCED GREASE-RESISTANCE AND GLUEABILITY

(75) Inventors: Richard F Rudolph, Mason, OH (US); Timothy J Bradford, Killen, AL (US); Barry Chapman, Germantown, TN (US); Pat Morabito, Matamoras, PA (US)

(73) Assignee: Internatonal Paper Company, Memphis, TN (US)

( * ) Notice: Subject to any disclaimer, the term of this patent is extended or adjusted under 35 U.S.C. 154(b) by 913 days.

(21) Appl. No.: 11/491,576

(22) Filed: Jul. 24, 2006

(65) Prior Publication Data

US 2007/0020462 A1 Jan. 25, 2007

Related U.S. Application Data

(60) Provisional application No. 60/702,109, filed on Jul. 22, 2005.

(51) Int. Cl.

| | |
|---|---|
| ***B32B 27/10*** | (2006.01) |
| ***B32B 29/00*** | (2006.01) |
| ***B32B 29/02*** | (2006.01) |
| ***B32B 29/04*** | (2006.01) |

(52) U.S. Cl. ..... 428/421; 428/34.2; 428/34.3; 428/34.6; 428/34.7; 428/34.8; 428/35.2; 428/35.4; 428/35.7; 428/36.4; 428/36.6; 428/36.7; 428/422; 428/537.5

(58) Field of Classification Search ..... 428/34.1–34.8, 428/35.2, 35.4, 35.7, 36.1, 36.2, 36.4, 36.6, 428/36.7, 421, 422, 532, 537.1, 537.5
See application file for complete search history.

(56) References Cited

U.S. PATENT DOCUMENTS

| | | | | |
|---|---|---|---|---|
| 3,484,281 | A | | 12/1969 | Guenthner |
| 4,022,965 | A | | 5/1977 | Goheen et al. |
| 4,075,136 | A | | 2/1978 | Schaper |
| 4,166,894 | A | | 9/1979 | Schaper |
| 4,174,417 | A | | 11/1979 | Rydell |
| 4,431,481 | A | | 2/1984 | Drach et al. |
| 4,496,427 | A | | 1/1985 | Davison |
| 4,565,641 | A | | 1/1986 | Chang et al. |
| 4,986,882 | A | | 1/1991 | Mackey et al. |
| 5,049,235 | A | | 9/1991 | Barcus et al. |
| 5,160,789 | A | | 11/1992 | Barcus et al. |
| 5,200,493 | A | | 4/1993 | Jacobson |
| 5,209,953 | A | | 5/1993 | Grupe et al. |
| 5,266,250 | A | | 11/1993 | Kroyer |
| 5,360,420 | A | | 11/1994 | Cook et al. |
| 5,443,899 | A | | 8/1995 | Barcus et al. |
| 5,460,839 | A | | 10/1995 | Archibald |
| 5,461,216 | A | | 10/1995 | McDonald |
| 5,531,728 | A | | 7/1996 | Lash |
| 5,573,693 | A | * | 11/1996 | Lorence et al. ..... 219/730 |
| 5,662,773 | A | | 9/1997 | Frederick et al. |
| 5,667,637 | A | | 9/1997 | Jewell et al. |
| 5,698,074 | A | | 12/1997 | Barcus et al. |
| 5,698,688 | A | | 12/1997 | Smith et al. |
| H1704 | H | | 1/1998 | Wallajapet et al. |
| 5,731,080 | A | | 3/1998 | Cousin et al. |
| 5,994,685 | A | | 11/1999 | Jackson |
| 6,010,595 | A | * | 1/2000 | Mitchell et al. ..... 162/129 |
| 6,146,494 | A | | 11/2000 | Seger et al. |
| 6,171,983 | B1 | | 1/2001 | Coppens |
| 6,361,651 | B1 | | 3/2002 | Sun |
| 6,471,824 | B1 | | 10/2002 | Jewell |
| 6,489,510 | B1 | | 12/2002 | Braun et al. |
| 6,506,282 | B2 | | 1/2003 | Hu et al. |
| 6,579,414 | B2 | | 6/2003 | Jewell |
| 6,579,415 | B2 | | 6/2003 | Jewell |
| 6,582,557 | B2 | | 6/2003 | Jewell |
| 6,592,712 | B2 | | 7/2003 | Koukoulas et al. |
| 6,592,717 | B2 | | 7/2003 | Jewell |
| 6,790,890 | B2 | | 9/2004 | MacCone et al. |
| 6,809,166 | B2 | | 10/2004 | Apostolo et al. |
| 6,818,717 | B2 | | 11/2004 | Kantamneni |
| 6,828,388 | B2 | | 12/2004 | Tortelli et al. |
| 6,919,111 | B2 | * | 7/2005 | Swoboda et al. ..... 428/34.2 |
| 7,534,323 | B2 | * | 5/2009 | Iengo et al. ..... 162/164.1 |
| 2003/0232211 | A1 | | 12/2003 | Kendall |

FOREIGN PATENT DOCUMENTS

| | | |
|---|---|---|
| EP | 1541497 | 6/2005 |
| WO | 0003089 | 1/2000 |

* cited by examiner

*Primary Examiner* — Walter B Aughenbaugh
(74) *Attorney, Agent, or Firm* — Thomas W. Barnes III; Amy L. Miller

(57) ABSTRACT

The invention relates to the papermaking art and, in particular, to the manufacture of paper substrates, paper-containing articles such as multilayered paper or paperboard packaging, containing a fluorine-containing compound and having enhanced glueability and/or grease resistance.

46 Claims, 2 Drawing Sheets

PAPER SUBSTRATE CONTAINING A FLUORINE CONTAINING COMPOUND AND HAVING ENHANCED GREASE-RESISTANCE AND GLUEABILITY

FIELD OF THE INVENTION

The invention relates to the papermaking art and, in particular, to the manufacture of paper substrates, paper-containing articles such as multilayered paper or paperboard packaging, containing a fluorine-containing compound and having enhanced glueability and/or grease resistance.

BACKGROUND OF THE INVENTION

Grease-resistant papers have been a desired commodity for some time. More specifically, paper substrates of cellulose fibers require additional components thereto, including chemistries, which render the substrate grease-resistant. Grease-resistant papers are not, per se, 100% resistant for an indefinite period of time, but instead are papers that provide grease holdout over a defined temporal space. Many commercial applications of grease resistant papers require longer and longer periods of time of grease holdout (either inside the paper substrate and/or outside the paper product).

In many commercial uses, grease resistant paper substrates must be glued together or to itself. The glueability of the substrate is critically dependent, in part, to the substrate's structural integrity. The structural integrity of the substrate is critically dependent upon the substrate's ability to contain and/or carry grease-containing products. While there are many conventional methods and chemistries that are available to be provided in paper substrates that would render such substrates grease resistant, such conventional chemistries and methods reduce the glueability of the substrates. The reduction in glueability causes the substrates to have a reduced structural integrity, severely limiting the strength of any substrate as well as its ability to carry heavy grease containing products.

SUMMARY OF THE INVENTION

One object of the invention is a paper substrate containing a web of cellulose fibers and a fluorocarbon-containing compound, the substrate having enhanced glueability and/or grease resistance, as well as methods of making and using the same. In one embodiment, the fluorocarbon-containing compound is dispersed throughout from 100% to 5% of the web. In another embodiment, the paper substrate may contain from 0.5 to 10 lbs fluorocarbon-containing compound/ton of paper substrate. In another embodiment, the paper substrate may contain from 2 to 6 lbs fluorocarbon-containing compound/ton of paper substrate. In yet another embodiment, the paper substrate may contain from 3 to 5 lbs fluorocarbon-containing compound/ton of paper substrate. In yet another embodiment, the concentration of the fluorocarbon-containing compound increases as one approaches the surface of the web. In yet another embodiment, the coating layer contains from 30 to 80 wt % solids. In another embodiment, the coating layer contains from 0.5 to not more than 50 parts starch, and at least 40 parts clay. In another embodiment, the coating layer optionally contains the fluorocarbon-containing compound. In one embodiment, the paper substrate may contain plurality of layers, each comprising a web of cellulose fibers. In another embodiment, the substrate is and/or contains a layer of kraft paper, optionally unbleached. In another embodiment, the fluorocarbon-containing compound is a perfluorinated polymer, perfluorinated copolymer, perfluoropolyether, or derivatives and/or salts thereof. In another embodiment, the fluorocarbon-containing compound is a metal or non-metal salt, preferably an ammonium salt thereof. In another embodiment, the substrate contains a wash coat in addition to or in lieu of the additional coating layer (that may or may not contain the fluorine-containing compound. In an additional embodiment, the wash coat may contain starch and clay, preferably from 5 to 30 wt % solids, at least 50 parts starch, and not more than 100 parts clay. In another embodiment, the substrate contains an adhesive layer. In a further embodiment, the adhesive layer may contain a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

Another object of the present invention relates to a paper substrate, as well as methods of making and using the same, containing a web of cellulose fibers as a first layer; a size-press applied layer containing the fluorocarbon-containing compound. In one embodiment, the size-press applied layer is in contact with at least a portion of the first layer. In another embodiment, from 0.5 to 100% of the size-press applied layer interpenetrates the first layer. In yet another embodiment, the concentration of the fluorocarbon-containing compound increases as one approaches the surface of the web. In another embodiment, the paper substrate contains at least one additional coating layer. In yet another embodiment, the coating layer contains from 30 to 80 wt % solids. In another embodiment, the coating layer contains from 0.5 to not more than 50 parts starch, and at least 40 parts clay. In another embodiment, the coating layer optionally contains the fluorocarbon-containing compound. In one embodiment, the paper substrate may contain plurality of layers, each comprising a web of cellulose fibers. In another embodiment, the substrate is and/or contains a layer of kraft paper, optionally unbleached. In another embodiment, the fluorocarbon-containing compound is a perfluorinated polymer, perfluorinated copolymer, perfluoropolyether, or derivatives and/or salts thereof. In another embodiment, the fluorocarbon-containing compound is a metal or non-metal salt, preferably an ammonium salt thereof. In another embodiment, the substrate contains a wash coat in addition to or in lieu of the additional coating layer (that may or may not contain the fluorine-containing compound. In an additional embodiment, the wash coat may contain starch and clay, preferably from 5 to 30 wt % solids, at least 50 parts starch, and not more than 100 parts clay. In another embodiment, the substrate contains an adhesive layer. In a further embodiment, the adhesive layer may contain a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

Another object of the invention is a paper substrate containing a web of cellulose fibers and a fluorocarbon-containing compound, the substrate having enhanced glueability and/or grease resistance, as well as methods of making and using the same, where the substrate contains from 0.01 to 10,000% of fluorine within from 0.1 to 10 nm of a top surface of the coating as measured by ESCA (electron spectroscopy chemical analysis and/or electron surface chemical analysis) based upon the total amount of fluorine of the paper substrate. In one embodiment, the paper substrate may contain plurality of layers, each comprising a web of cellulose fibers. In another embodiment, the substrate is and/or contains a layer of kraft paper, optionally unbleached. In another embodiment, the fluorocarbon-containing compound is a perfluorinated polymer, perfluorinated copolymer, perfluoropolyether, or derivatives and/or salts thereof. In another embodiment, the fluorocarbon-containing compound is a metal or non-metal salt, preferably an ammonium salt thereof. In another embodiment, the substrate contains a wash coat in addition to or in lieu of the additional coating layer (that may or may not contain the fluorine-containing compound. In an additional embodiment, the wash coat may contain starch and clay, preferably from 5 to 30 wt % solids, at least 50 parts starch, and not more than 100 parts clay. In another embodiment, the substrate contains an adhesive layer. In a further embodiment, the adhesive layer may contain a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

Another object of the present invention relates to a paper substrate having a surface that has a first total surface energy that is the first sum of a first polar component and a first dispersive component and that, when in contact with an adhesive having a second total surface energy that is the second sum of a second polar component and a second dispersive component, contains the ratio of first polar component/first total surface energy that is from 1 to 200% that of the ratio of second polar component/second total surface energy for the adhesive. In one embodiment, at least one surface of the substrate has a first total surface energy that is less than 75 $mJ/m^2$. In another embodiment, the substrate contains a web of cellulose fibers and a fluorocarbon-containing compound, the substrate having enhanced glueability and/or grease resistance, as well as methods of making and using the same. In one embodiment, the fluorocarbon-containing compound is dispersed throughout from 100% to 5% of the web. In another embodiment, the paper substrate may contain from 0.5 to 10 lbs fluorocarbon-containing compound/ton of paper substrate. In another embodiment, the paper substrate may contain from 2 to 6 lbs fluorocarbon-containing compound/ton of paper substrate. In yet another embodiment, the paper substrate may contain from 3 to 5 lbs fluorocarbon-containing compound/ton of paper substrate. In yet another embodiment, the concentration of the fluorocarbon-containing compound increases as one approaches the surface of the web. In yet another embodiment, the coating layer contains from 30 to 80 wt % solids. In another embodiment, the coating layer contains from 0.5 to not more than 50 parts starch, and at least 40 parts clay. In another embodiment, the coating layer optionally contains the fluorocarbon-containing compound. In one embodiment, the paper substrate may contain plurality of layers, each comprising a web of cellulose fibers. In another embodiment, the substrate is and/or contains a layer of kraft paper, optionally unbleached. In another embodiment, the fluorocarbon-containing compound is a perfluorinated polymer, perfluorinated copolymer, perfluoropolyether, or derivatives and/or salts thereof. In another embodiment, the fluorocarbon-containing compound is a metal or non-metal salt, preferably an ammonium salt thereof. In another embodiment, the substrate contains a wash coat in addition to or in lieu of the additional coating layer (that may or may not contain the fluorine-containing compound. In an additional embodiment, the wash coat may contain starch and clay, preferably from 5 to 30 wt % solids, at least 50 parts starch, and not more than 100 parts clay. In another embodiment, the substrate contains an adhesive layer. In a further embodiment, the adhesive layer may contain a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

Another object of the present invention relates to a paper substrate having at least one surface having a first total surface energy that is the first sum of a first polar component and a first dispersive component and has a ratio of first polar component/first total surface energy that is less than 30%. In one embodiment, at least one surface of the substrate has a first total surface energy that is less than 75 $mJ/m^2$. In another embodiment, the substrate contains a web of cellulose fibers and a fluorocarbon-containing compound, the substrate having enhanced glueability and/or grease resistance, as well as methods of making and using the same. In one embodiment, the fluorocarbon-containing compound is dispersed throughout from 100% to 5% of the web. In another embodiment, the paper substrate may contain from 0.5 to 10 lbs fluorocarbon-containing compound/ton of paper substrate. In another embodiment, the paper substrate may contain from 2 to 6 lbs fluorocarbon-containing compound/ton of paper substrate. In yet another embodiment, the paper substrate may contain from 3 to 5 lbs fluorocarbon-containing compound/ton of paper substrate. In yet another embodiment, the concentration of the fluorocarbon-containing compound increases as one approaches the surface of the web. In yet another embodiment, the coating layer contains from 30 to 80 wt % solids. In another embodiment, the coating layer contains from 0.5 to not more than 50 parts starch, and at least 40 parts clay. In another embodiment, the coating layer optionally contains the fluorocarbon-containing compound. In one embodiment, the paper substrate may contain plurality of layers, each comprising a web of cellulose fibers. In another embodiment, the substrate is and/or contains a layer of kraft paper, optionally unbleached. In another embodiment, the fluorocarbon-containing compound is a perfluorinated polymer, perfluorinated copolymer, perfluoropolyether, or derivatives and/or salts thereof. In another embodiment, the fluorocarbon-containing compound is a metal or non-metal salt, preferably an ammonium salt thereof. In another embodiment, the substrate contains a wash coat in addition to or in lieu of the additional coating layer (that may or may not contain the fluorine-containing compound. In an additional embodiment, the wash coat may contain starch and clay, preferably from 5 to 30 wt % solids, at least 50 parts starch, and not more than 100 parts clay. In another embodiment, the substrate contains an adhesive layer. In a further embodiment, the adhesive layer may contain a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

Another object of the present invention, the paper substrate has at least one surface having a first total surface energy that is the first sum of a first polar component and a first dispersive component and the first polar component is less than 20 ml/m$^2$. In another embodiment, the substrate contains a web of cellulose fibers and a fluorocarbon-containing compound, the substrate having enhanced glueability and/or grease resistance, as well as methods of making and using the same. In one embodiment, the fluorocarbon-containing compound is dispersed throughout from 100% to 5% of the web. In another embodiment, the paper substrate may contain from 0.5 to 10 lbs fluorocarbon-containing compound/ton of paper substrate. In another embodiment, the paper substrate may contain from 2 to 6 lbs fluorocarbon-containing compound/ton of paper substrate. In yet another embodiment, the paper substrate may contain from 3 to 5 lbs fluorocarbon-containing compound/ton of paper substrate. In yet another embodiment, the concentration of the fluorocarbon-containing compound increases as one approaches the surface of the web. In yet another embodiment, the coating layer contains from 30 to 80 wt % solids. In another embodiment, the coating layer contains from 0.5 to not more than 50 parts starch, and at least 40 parts clay. In another embodiment, the coating layer optionally contains the fluorocarbon-containing compound. In one embodiment, the paper substrate may contain plurality of layers, each comprising a web of cellulose fibers. In another embodiment, the substrate is and/or contains a layer of kraft paper, optionally unbleached. In another embodiment, the fluorocarbon-containing compound is a perfluorinated polymer, perfluorinated copolymer, perfluoropolyether, or derivatives and/or salts thereof. In another embodiment, the fluorocarbon-containing compound is a metal or non-metal salt, preferably an ammonium salt thereof. In another embodiment, the substrate contains a wash coat in addition to or in lieu of the additional coating layer (that may or may not contain the fluorine-containing compound. In an additional embodiment, the wash coat may contain starch and clay, preferably from 5 to 30 wt % solids, at least 50 parts starch, and not more than 100 parts clay. In another embodiment, the substrate contains an adhesive layer. In a further embodiment, the adhesive layer may contain a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

Another object of the present invention relates to an article containing at least any one or more of the above and below mentioned paper substrates of the present invention. In one embodiment, the article may be used to package, transport, and/or hold a grease-containing material. In another embodiment, the article may be a bag. In another embodiment, the article may be single ply. In another embodiment, the article may be multiply. In another embodiment, the article may be a bag, preferably a multiwalled bag. In another embodiment, the article may be a food-containing bag. In yet another embodiment, the article is from 5 to 10,000% more grease resistant as compared to that of an article that does not contain containing at least any one or more of the above and below mentioned paper substrates of the present invention. In another embodiment, the article is from 5 to 10,000% more glueable as compared to that of an article that does not contain containing at least any one or more of the above and below mentioned paper substrates of the present invention.

The construction and method of operation of the invention, however, together with additional objects and advantages thereof will be best understood from the following description of specific embodiments when read in connection with the accompanying examples and claims. These and additional aspects of the invention are described herein, but are in no way meant to be deemed limited to only these embodiments.

DETAILED DESCRIPTION OF THE INVENTION

Figure 1:
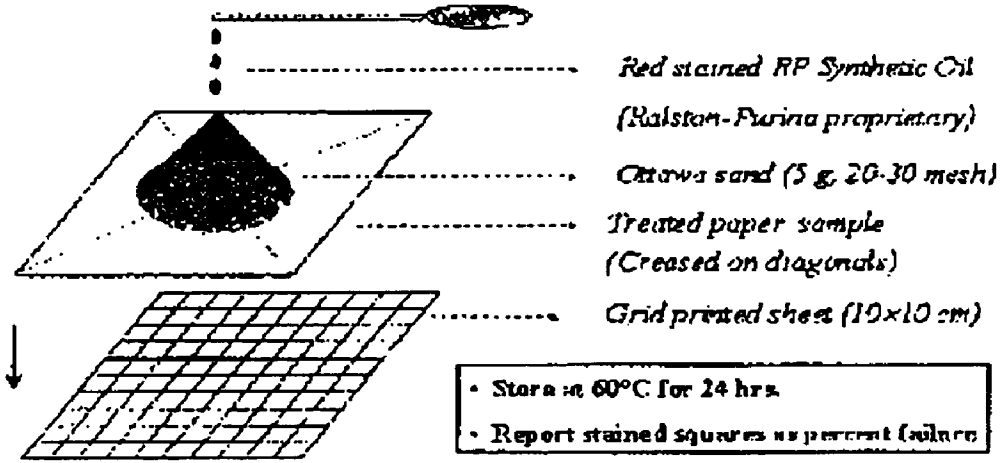
FIG. 1: Provides a detailed view of the RP-2 test set-up.

The inventors have found a paper substrate that is capable having enhanced grease resistance and enhanced glueability. Therefore, the inventors have discovered a superior paper substrate that resists grease over a longer period of time and/or has an enhanced capacity to be glued to itself or other paper substrates leading to a substrate that, when glued, has superior structural integrity.

The paper substrate of the present invention may contain recycled fibers and/or virgin fibers. Recycled fibers differ from virgin fibers in that the fibers have gone through the drying process at least once.

The paper substrate of the present invention may contain from 1 to 100 wt %, preferably from 50 to 100 wt %, most preferably from 80 to 100 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein. More preferred amounts of cellulose fibers range from wt %.

Preferably, the sources of the cellulose fibers are from softwood and/or hardwood. The paper substrate of the present invention may contain from 1 to 99 wt %, preferably from 5 to 95 wt %, cellulose fibers originating from softwood species based upon the total amount of cellulose fibers in the paper substrate. This range includes 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate of the present invention may contain from 1 to 99 wt %, preferably from 5 to 95 wt %, cellulose fibers originating from hardwood species based upon the total amount of cellulose fibers in the paper substrate. This range includes 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means including crosslinking and precipitation of complexes thereon.

Examples of such modification of fibers may be, but is not limited to, those found in the following U.S. Pat. Nos. 6,592,717, 6,592,712, 6,582,557, 6,579,415, 6,579,414, 6,506,282, 6,471,824, 6,361,651, 6,146,494, H1,704, 5,731,080, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated, in their entirety, herein by reference.

The paper substrate may contain a fluorine containing compound. An example of the fluorine containing compound is fluorine containing polymer and fluorine containing copolymer. Examples of a fluorine containing polymer and fluorine containing copolymer is ammonium di-[2-(N-ethyl-heptadecafluorosulfonamido)ethyl]phosphate. Ammonium di-[2-(N-ethyl-heptadecafluorosulfonamido)ethyl]phosphate is commercially available as "SCOTCHBAN FC-807" or "SCOTCHBAN FC-807A" (trademarks of 3M). "SCOTCHBAN FC-807 can be formed by the reaction of 2,2-bis,[Γ,ω-perfluoro $C_{4-20}$ alkylthio)methyl] 1,3-propanediol, polyphosphoric acid and ammonium hydroxide. Other suitable fluorine containing moiety polymers include fluorochemical phosphates. One commercially available fluorochemical phosphate is "SCOTCHBAN FC-809" (a trademark of 3M). "SCOTCHBAN FC-809" is an ammonium salt of a fluoroaliphatic polymer. Other suitable fluorine containing moiety polymers include fluoroalkyl polymers. Suitable fluoroalkyl polymers include poly(2-(N-methyl-heptadecafluorosulfonamido)ethyl acrylate)-co-(2,3-epoxypropylacrylate)-co-(2-ethoxyethylacrylate)-co-(2-(2-methylpropenyloyloxy)ethyl-trimethylammonium chloride), and poly(2-(N-methyl-heptadecafluorosulfonamido)ethyl acrylate)-co-(2,3-epoxypropylacrylate)-co-(2-ethoxyethylacrylate)-co-(2-(2-methylpropenyloyloxy)ethyl-trimethylammonium chloride) commercially available as "SCOTCHBAN FC-845" or "SCOTCHBAN FX-845" (a trademark of 3M). "SCOTCHBAN FC-845" contains 35 to 40 weight percent fluorine and can be produced by the copolymerization of ethanaminium, N,N,N-trimethyl-2-[(2-methyl-1-oxo-2-propenyl)-oxy]-, chloride; 2-propenoic acid, 2-methyl-, oxiranylmethylester; 2-propenoic acid, 2-ethoxyethyl ester; and 2-propenoic acid, 2-[[(heptadecafluoro-octyl)sulfonyl]methyl amino]ethyl ester. Another suitable commercially available fluorine containing moiety polymer includes "SEQUAPEL 1422" (a registered trademark of Sequa Chemicals, Inc.). Other suitable commercially available fluorine containing moiety polymers include "LODYNE® P-201" and "LODYNE® P-208E." "LODYNE® P-201" and "LODYNE® P-208E" are registered trademarks of Ciba-Geigy Corporation, Greensboro, N.C. "LODYNE® P-201" comprises a fluorinated organic acid diethanolamine salt having a 34% solids content, the remaining 66% comprising water. "LODYNE® P-208E" comprises a fluorinated alcohol phosphate ester salt having a 24% solids content, a 10% propylene glycol content, and a 66% water content.

Additional examples of the fluorine containing compounds are those non-telomer based fluorochemicals, those having fluorine-telomer chemistries, those having FluoroPolyEther chemistries, those having PFPE (perFluoroPolyEther)-diol chemistries. Examples of PFPEs that are preferred are those from Solvay, such as Solvera PT 5071. The fluorine containing compounds may be a salt, preferably an ammonium salt. Further Examples of fluorine containing compounds useful in the paper substrate can be found in U.S. Pat. Nos. 6,828,388; 6,919,111; 6,809,166; 6,790,890; 6,489,510 and 6,818,717, which are hereby incorporated, in their entirety, herein by reference.

The amount of fluorine containing compound in the paper substrate may be from 0.5 to 25 lbs of fluorine containing compound per ton of substrate. The amount of fluorine containing compound in the paper substrate may be 0.5, 0.6, 0.7, 0.8, 0.9, 1.0, 1.2, 1.4, 1.6, 1.8, 2.0, 2.2, 2.4, 2.5, 3.0, 3.5, 4.0, 4.5, 5.0, 5.5, 6.0, 6.5, 7.0, 7.5, 8.0, 8.5, 9.0, 9.5, 10, 11, 12, 13, 14, 15, 16, 17, 18, 19, 20, 21, 22, 23, 24 and 25 lbs of fluorine containing compound per dry ton of substrate, including any and all ranges and subranges therein. The lbs and tons may be wet or dry.

The paper substrate may be made by contacting the fluorine containing compound with the cellulose fibers at any time during the papermaking process. Still further, the contacting may occur at acceptable concentration levels that provide the paper substrate of the present invention to contain any of the above-mentioned amounts of cellulose and fluorine containing compound. The contacting may occur anytime in the papermaking process including, but not limited to the thick stock, thin stock, head box, and coater with the preferred addition point being at the thin stock. Further addition points include machine chest, stuff box, and suction of the fan pump. An additional preferred contacting occurs at the size press; and, may or may not be combined with any of the above-mentioned contacting points.

When the fluorine containing compound is contacted with the fibers at the size press, the size press composition may further contain any additional component including those optional substances mentioned below. Preferably, the sizing composition is applied by a puddle size press and/or a rod-metered size press.

The sizing composition may preferably contain the fluorine containing compound and an orientation and/or affixing agent. The orientation compound and/or affixing agent helps to orient the fluorine containing compound in, among, and/or on the fibers in a manner that maximizes the fluorine containing compound's capability to provide the paper substrate with enhanced grease resistance and/or glueability. Further, the orientation compound and/or affixing agent helps retain the fluorine containing compound in, among, and/or on the fibers.

The orientation compound and/or affixing agent may be one of the optional substances mentioned below, preferably the retention aids mentioned below. More preferably, the orientation compound is a nitrogen-containing organic species. Examples of such preferred nitrogen-containing organic species include poly(diallyldimethyl ammonium chloride) (e.g. polyDADMAC or DADMAC). Such polyDADMAC or DADMAC are those available, for example, from Nalco Chemical Company, such as for example, Nalco's Nalkat 2020 commercial product.

Suitable examples of nitrogen containing organic species, compounds, oligomers and polymers are those containing one or more quaternary ammonium functional groups. Such functional groups may vary widely and include substituted and unsubstituted amines, imines, amides, urethanes, quaternary ammonium groups, dicyandiamides and the like. Illustrative of such materials are polyamines, polyethyleneimines, copolymers of diallyldimethyl ammonium chloride (DADMAC), copolymers of vinyl pyrrolidone (VP) with quaternized diethylaminoethylmethacrylate (DEAMEMA), polyamides, cationic polyurethane latex, cationic polyvinyl alcohol, polyalkylamines dicyandiamid copolymers, amine glycigyl addition polymers, poly[oxyethylene (dimethyliminio) ethylene (dimethyliminio) ethylene] dichlorides.

Preferred nitrogen containing organic species for use in the practice of this invention are low to medium molecular weight cationic polymers and oligomers having a molecular equal to or less than 100,000, preferably equal to or less than about 50,000 and more preferably from about 10,000 to about 50,000. Illustrative of such materials are polyalkylamine dicyandiamide copolymers, poly[oxyethylene(dimethyliminio ethylene(dimethyliminioethylene] dichlorides and polyamines having molecular weights within the desired range. More preferred nitrogen containing organic species for use in the practice of this invention are low molecular weight cationic polymers such as polyalkylamine dicyandiamid copolymer, poly[oxyethylene (dimethyliminio)ethylene (dimethyliminio)ethylene] dichloride. Most preferred nitrogen containing organic species for use in the practice of this invention are low molecular weight polyalkylamine dicyandiamid copolymers. The molecular weights may be measure as weight average or number average molecular weights.

The paper substrate may contain any amount of the orientation compound, preferably less than 10 lbs orientation compound/ton of paper substrate, more preferably less than 5 lbs orientation compound/ton of paper substrate, most preferably less than 2 lbs orientation compound/ton of paper substrate. When the substrate contains the orientation compound, it is preferable that it contain at least 0.05 lbs, more preferably at least 0.1 lbs, most preferably at least 0.5 lbs orientation compound/ton of substrate. These ranges include 0.05, 0.075, 0.1, 0.25, 0.5, 0.75, 1.0, 1.25, 1.5, 2.0, 2.5, 3.0, 3.5, 4.0, 4.5, 5.0, 6.0, 7.0, 8.0, 9.0, and 10.0 lbs orientation compound/ton of substrate, including any and all ranges and subranges therebetween.

The paper substrate according to the present invention may be made off of the paper machine having either a high or low basis weight, including basis weights of at least 10 lbs/3000 square foot, preferably from at least 20 to 500 lbs/3000 square foot, more preferably from at least 25 to 325 lbs/3000 square foot, most preferably from 25 to 60 lbs/3000 square foot. The basis weight of the substrate may be 20, 25, 30, 35, 40, 45, 50, 55, 60, 65, 70, 75, 80, 85, 90, 100, 110, 120, 130, 140, 150, 160, 170, 180, 190, 200, 225, 250, 275, 300, 350, 400, 450, and 500 lbs/3000 square foot, including any and all ranges and subranges therebetween.

The paper substrate according to the present invention may have a caliper of from 2 to 35 mil, preferably from 5 to 30 mil, more preferably from 10 to 28 mil, most preferably from 12 to 24 mil. The caliper of the substrate may be 2, 4, 6, 8, 10, 12, 13, 14, 15, 16, 17, 18, 19, 20, 21, 22, 23, 24, 26, 28, 30, 32, 34, and 35 mils, including any and all ranges and subranges therebetween.

The paper substrate of the present invention may contain a size press applied layer. The size press applied layer may contain the fluorine containing compound at any amount so long as to satisfy the amounts provided above to be contained by the substrate. The size press applied layer may or may not interpenetrate the layer of cellulose fibers. When interpenetration occurs, the web and the size press applied layer may interpenetrate from 0.5 to 100% based upon the thickness of the size press applied layer. The web and the size press applied layer may interpenetrate from at least 0.5, at least 2%, at least 5% at least 10%, at least 20%, at least 25%, at least 30%, at least 35%, at least 40%, at least based upon the thickness of the size press applied layer. The web and the size press applied layer may interpenetrate from not more than 55%, not more than 60%, not more than 65%, not more than 75%, not more than 80%, not more than 90%, and not more than 100% based upon the thickness of the size press applied layer, including any and all ranges and subranges therein.

The paper substrate may also contain a coating layer composition in contact with at least one surface of the substrate. The coating layer may or may not contain the above-mentioned fluorine containing compound. The coating layer may or may not be interpenetrated with the web of cellulose fibers. When interpenetration occurs, interpenetration may be from 0 to 100% based upon the thickness of the coating layer. The interpenetration may be 0, 1, 2, 5, 10, 15, 20, 30, 40, 50, 60, 70, and 80%, including any and all ranges and subranges therein.

The coating layer composition may have a coat weight of from 0.5 to 20 lbs, preferably 1 to 15, most preferably from 6 to 10 of coat weight per 3300 square foot ream. The coat weight may be 0.5, 1, 2, 3, 4, 5, 6, 7, 8, 9, 10, 11, 12, 13, 14, 15, 16, 17, 18, 19, and 20 lbs of coat weight per 3300 square foot ream, including any and all ranges and subranges therein.

While the coating layer may contain any and/or all of the optional components mentioned below, it is preferable that the coating layer contain clay (preferably greater than 40 parts), latex, resin, calcium carbonate, titanium, pigment that is preferably plastic pigment, and starch that is preferably ethylated. Further, the coating layer may contain the fluorine containing compound.

The coating layer may contain from 35 to 85% solids, preferably from 50 to 75% solids, most preferably from 55 to 70% solids. The % solids of the coating layer may be 35, 40, 45, 50, 55, 60, 60.5, 65, 70, 75, 80, and 85%, including any and all ranges and subranges therein.

The paper substrate may contain a wash layer, e.g. backwash layer, composition in contact with at least one surface of the substrate. The wash layer may or may not be interpenetrated with the web of cellulose fibers. When interpenetration occurs, interpenetration may be from 0 to 100% based upon the thickness of the wash layer. The interpenetration may be 0, 1, 2, 5, 10, 15, 20, 30, 40, 50, 60, 70, and 80%, including any and all ranges and subranges therein.

The wash composition may have a weight of from 0.25 to 10 lbs, preferably 1 to 8, most preferably from 2 to 6 of coat weight per 3300 square foot ream. The weight may be 0.5, 1, 2, 3, 4, 5, 6, 7, 8, 9, and 10 lbs of coat weight per 3300 square foot ream, including any and all ranges and subranges therein.

While the wash layer may contain any and/or all of the optional components mentioned below, it is preferable that the wash layer contain clay (preferably less than 100 parts), latex, calcium carbonate, and starch (preferably greater than 100 parts, most preferably greater than 150 parts) that is preferably ethylated. When the wash layer contains clay, it may contain any amount of clay, but it is preferable that it contains less than 100 but greater than 1 part of clay. The wash layer may contain 1, 2, 5, 10, 15, 20, 25, 30, 35, 40, 45, 50, 55, 60, 65, 70, 75, 80, 85, 90, 95 and 100 parts clay, including any and all ranges and subranges therein. When the wash layer contains starch, it may contain any amount of starch but it is preferable that the wash layer contain at least 100 parts starch, more preferably at least 110 parts starch, most preferably at least 150 parts starch. The starch content in the wash layer may be 90, 95, 100, 110, 120, 125, 130, 140, 150, 160, 170, 180, 190, 200 parts, including any and all ranges and subranges therein The wash layer may contain from 2 to 50% solids, preferably from 10 to 30% solids, most preferably from 20 to 25% solids. The % solids of the wash layer may be 2, 5, 10, 15, 20, 23, 25, 30, 35, 40, 45, and 50%, including any and all ranges and subranges therein.

The coat and/or wash layers may be applied to the substrate by any coating method. However, the preferable methods include a stainless steel rigid blade and/or a bent blade coater.

When the substrate contains the coat layer and/or wash layer, the substrate may be any basis weight, preferably having a basis weight of from 25 to 100 lbs, more preferably from 30 to 85 lbs, most preferably from 30 to 80 lbs per 3000 square feet. The basis weight may be 25, 26, 27, 28, 30, 31, 32, 33, 34, 35, 36, 37, 38, 39, 40, 45, 50, 55, 60, 65, 70, 75, 80, 85, 90, 95 and 100 lbs per 3000 square feet, including any and all ranges and subranges therein.

The paper substrate and/or the above-mentioned layers may comprise optional components. Optional substances may include retention aids, sizing agents, binders, fillers, thickeners, and preservatives. Examples of fillers include, but are not limited to; clay, calcium carbonate, calcium sulfate hemihydrate, and calcium sulfate dehydrate. A preferable filler is calcium carbonate with the preferred form being precipitated calcium carbonate. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. Other optional substances include, but are not limited to silicas such as colloids and/or sols. Examples of silicas include, but are not limited to, sodium silicate and/or borosilicates. Another example of optional substances is solvents including but not limited to water.

The paper substrate of the present invention may also contain a surface and/or an internal sizing agent such as starch and/or modified and/or functional equivalents thereof at a wt % of from 0.05 wt % to 20 wt %, preferably from 5 to 15 wt % based on the total weight of the substrate. The wt % of starch contained by the substrate may be 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein. Examples of modified starches include, for example, oxidized, cationic, ethylated, hydroethoxylated, etc. Examples of functional equivalents are, but not limited to, polyvinyl alcohol, polyvinylamine, alginate, carboxymethyl cellulose, etc. The surface sizing agent may or may not be added to the coating composition and/or the size press composition that may further optionally contain the fluorine containing compound.

Further, the starch may be of any type, including but not limited to oxidized, ethylated, cationic and pearl, and is preferably used in aqueous solution. Illustrative of useful starches for the practice of this preferred embodiment of the invention are naturally occurring carbohydrates synthesized in corn, tapioca, potato and other plants by polymerization of dextrose units. All such starches and modified forms thereof such as starch acetates, starch esters, starch ethers, starch phosphates, starch xanthates, anionic starches, cationic starches and the like which can be derived by reacting the starch with a suitable chemical or enzymatic reagent can be used in the practice of this invention.

Useful starches may be prepared by known techniques or obtained from commercial sources. For example, the suitable starches include PG-280 from Penford Products, SLS-280 from St. Lawrence Starch, the cationic starch CatoSize 270 from National Starch and the hydroxypropyl No. 02382 from Poly Sciences, Inc.

Preferred starches for use in the practice of this invention are modified starches. More preferred starches are cationic modified or non-ionic starches such as CatoSize 270 and KoFilm 280 (all from National Starch) and chemically modified starches such as PG-280 ethylated starches and AP Pearl starches. More preferred starches for use in the practice of this invention are cationic starches and chemically modified starches.

The paper substrate of the present invention may contain retention aids selected from the group consisting of coagulation agents, flocculation agents, and entrapment agents dispersed within the bulk and porosity enhancing additives cellulosic fibers.

Retention aids for the bulk-enhancing additives to retain a significant percentage of the additive in the middle of the paperboard and not in the periphery. Suitable retention aids function through coagulation, flocculation, or entrapment of the bulk additive. Coagulation comprises a precipitation of initially dispersed colloidal particles. This precipitation is suitably accomplished by charge neutralization or formation of high charge density patches on the particle surfaces. Since natural particles such as fines, fibers, clays, etc., are anionic, coagulation is advantageously accomplished by adding cationic materials to the overall system. Such selected cationic materials suitably have a high charge to mass ratio. Suitable coagulants include inorganic salts such as alum or aluminum chloride and their polymerization products (e.g. PAC or poly aluminum chloride or synthetic polymers); poly(diallyldimethyl ammonium chloride) (i.e., DADMAC); poly (dimethylamine)-co-epichlorohydrin; polyethylenimine; poly(3-butenyltrimethyl ammoniumchloride); poly(4-ethenylbenzyltrimethylammonium chloride); poly(2,3-epoxypropyltrimethylammonium chloride); poly(5-isoprenyltrimethylammonium chloride); and poly (acryloyloxyethyltrimethylammonium chloride). Other suitable cationic compounds having a high charge to mass ratio include all polysulfonium compounds, such as, for example the polymer made from the adduct of 2-chloromethyl; 1,3-butadiene and a dialkylsulfide, all polyamines made by the reaction of amines such as, for example, ethylenediamine, diethylenetriamine, triethylenetetraamine or various dialkylamines, with bis-halo, bis-epoxy, or chlorohydrin compounds such as, for example, 1-2 dichloroethane, 1,5-diepoxyhexane, or epichlorohydrin, all polymers of guanidine such as, for example, the product of guanidine and formaldehyde with or without polyamines. The preferred coagulant is poly(diallyldimethyl ammonium chloride) (i.e., DADMAC) having a molecular weight of about ninety thousand to two hundred thousand and polyethylenimene having a molecular weight of about six hundred to 5 million. The molecular weights of all polymers and copolymers herein this application are based on a weight average molecular weight commonly used to measure molecular weights of polymeric systems.

Another advantageous retention system suitable for the manufacture of paperboard of this invention is flocculation. This is basically the bridging or networking of particles through oppositely charged high molecular weight macromolecules. Alternatively, the bridging is accomplished by employing dual polymer systems. Macromolecules useful for the single additive approach are cationic starches (both amylase and amylopectin), cationic polyacrylamide such as for example, poly(acrylamide)-co-diallyldimethyl ammonium chloride; poly(acrylamide)-co-acryloyloxyethyl trimethylammonium chloride, cationic gums, chitosan, and cationic polyacrylates. Natural macromolecules such as, for example, starches and gums, are rendered cationic usually by treating them with 2,3-epoxypropyltrimethylammonium chloride, but other compounds can be used such as, for example, 2-chloroethyl-dialkylamine, acryloyloxyethyldialkyl ammonium chloride, acrylamidoethyltrialkylammonium chloride, etc. Dual additives useful for the dual polymer approach are any of those compounds which function as coagulants plus a high molecular weight anionic macromolecule such as, for example, anionic starches, CMC (carboxymethylcellulose), anionic gums, anionic polyacrylamides (e.g., polyacrylamide)-co-acrylic acid), or a finely dispersed colloidal particle (e.g., colloidal silica, colloidal alumina, bentonite clay, or polymer micro particles marketed by Cytec Industries as Polyflex). Natural macromolecules such as, for example, cellulose, starch and gums are typically rendered anionic by treating them with chloroacetic acid, but other methods such as phosphorylation can be employed. Suitable flocculation agents are nitrogen containing organic polymers having a molecular weight of about one hundred thousand to thirty million. The preferred polymers have a molecular weight of about ten to twenty million. The most preferred have a molecular weight of about twelve to eighteen million. Suitable high molecular weight polymers are polyacrylamides, anionic acrylamide-acrylate polymers, cationic acrylamide copolymers having a molecular weight of about five hundred thousand to thirty million and polyethylenimenes having molecular weights in the range of about five hundred thousand to two million.

The third method for retaining the bulk additive in the fiberboard is entrapment. This is the mechanical entrapment of particles in the fiber network. Entrapment is suitably achieved by maximizing network formation such as by forming the networks in the presence of high molecular weight anionic polyacrylamides, or high molecular weight polyethyleneoxides (PEO). Alternatively, molecular nets are formed in the network by the reaction of dual additives such as, for example, PEO and a phenolic resin.

The paper substrate of the present invention may contain from 0.001 to 20 wt % of the optional substances based on the total weight of the substrate, preferably from 0.01 to 10 wt %, most preferably 0.1 to 5.0 wt %, of each of at least one of the optional substances. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The optional substances may be dispersed throughout the cross section of the paper substrate or may be more concentrated within the interior of the cross section of the paper substrate. Further, other optional substances such as binders for example may be concentrated more highly towards the outer surfaces of the cross section of the paper substrate. More specifically, a majority percentage of optional substances such as binders may preferably be located at a distance from the outside surface of the substrate that is equal to or less than 25%, more preferably 10%, of the total thickness of the substrate. Still further, the optional substance may be formulated in at least one coating or wash coat layer and these layers may interpenetrate the cellulose web of the paper substrate and/or sit on an outside surface thereof.

The paper substrate may be made by contacting the optional substances mentioned above with the cellulose fibers and the fluorine containing compound at any time during the papermaking process. The optional substances may be contacted with the cellulose fibers and/or the fluorine containing compound at the wet end, size press, and/or coater. Still further, the contacting may occur at acceptable concentration levels that provide the paper substrate of the present invention to contain any of the above-mentioned amounts of cellulose and fluorine containing compound and/or the optional substances. The contacting may occur anytime in the papermaking process including, but not limited to the thick stock, thin stock, head box, and coater with the preferred addition point being at the thin stock. Further addition points include machine chest, stuff box, and suction of the fan pump.

The paper substrate of the present invention preferably is utilized to create articles. Accordingly, converting methodologies may be used to incorporate the substrate into the article. One preferred article is an article that may be used to contain a grease-containing product. The most preferred article is a sack and/or bag. The most preferred grease-containing product is food, preferably pet food. Accordingly, the substrate and article has improved grease resistance as measured by either the RP-2 Test (attached) and/or the Aggressive Pet Food Test (attached), which are hereby incorporated by reference in their entirety.

The paper substrate and/or article of the present invention has a grease resistance that is from at least 5% to 10000% improved over conventional substrates and/or substrates. The grease resistance may be 5, 10, 15, 20, 25, 30, 35, 40, 50, 60, 70, 80, 90, 100, 200, 300, 400, 500, 600, 700, 800, 900, 1000, 2000, 3000, 4000, 5000, 6000, 7000, 8000, 9000, and 10000% greater than that of conventional substrates and/or articles, including any and all ranges and subranges therein.

The paper substrate of the present invention preferably is utilized to create articles. Accordingly, converting methodologies may be used to incorporate the substrate into the article. One preferred article is an article that may be used to contain a grease-containing product. The most preferred article is a sack and/or bag. In many cases, the substrate is folded and glued/adhered to itself or additional paper substrates. The quality of the substrates ability to be glued and/or adhered critically impacts the structural integrity of the article made from that substrate. This quality is known as the substrate's and/or article's glueability which can be measured by certain tests described hereinbelow, such as the Rock Ten Hot Melt Bond Simulation and the Hot Melt Tear Test using the same as discussed below.

In some instances, the presence of the fluorine-containing compound greatly reduces the ability of substrates to adhere to one another. In such cases, not any conventional adhesive may be used in the adhesive layer. Preferably, the adhesive should provide an open time of from 0.1 to 5.0, more preferably 0.5 to 3.5 seconds, most preferably 1.0 to 2.0 seconds. In addition and/or in alternative, the adhesive should provide a dwell time for compression of 0.1 to 4.0 seconds, preferably 0.25 to 3.0 seconds, more preferably from 0.5 to 1.5 seconds. In addition and/or in alternative, the adhesive must satisfy the below mentioned initial fiber tear test (Hot melt Bonding Test attached below) which is the use of a Rock-Term hot melt simulator using settings of, 300 to 450 deg F., preferably from 350 to 400 deg F., the above-mentioned open time (preferably ~1.5 sec open time), with the above-mentioned dwell time (preferably ~1.0 sec dwell time), and with tearing force applied immediately after dwell time to simulate springback forces during conversion of packages made from the substrate of the present invention.

The Hot Melt Bonding Test provides a value of simulating the hog melt gluing process in the lab so as determine the effects of major variables such as substrate, adhesive, temperature, open and dwell times, and adhesive amount upon gluing. In the present application, this test was performed in the lab when two strips of paper are cut CD (cross direction) long: 2.5"×8" and 1"×8" specimens respectively. The adhesive is applied at the temperatures ranging from 350 to 400 degree F. to the uncoated side of the 2.5"×8" specimen with a 1.5 second of open time. The coated side of the second 1"×8" is compressed onto this for 1.0 seconds of compression time. The samples are glued, cooled, and torn along the length of the glue bead at TAPPI Standard Conditions (73 degree F., 50% Relative Humidity). This is an adequate test for glueability of the paper substrate.

The paper substrate and/or article of the present invention has a glueability that is from at least 5% to 10000% improved over conventional substrates and/or substrates. The grease resistance may be 5, 10, 15, 20, 25, 30, 35, 40, 50, 60, 70, 80, 90, 100, 200, 300, 400, 500, 600, 700, 800, 900, 1000, 2000, 3000, 4000, 5000, 6000, 7000, 8000, 9000, and 10000% greater than that of conventional substrates and/or articles, including any and all ranges and subranges therein.

The paper substrate of the present invention has at least one surface (with or without the coat layer and/or wash layer) that has a total surface energy. The total surface energy is the sum of a polar component and a dispersive component. The surface energies, as well as the polar and dispersive components, were measured as described herein below.

The paper substrate may have any total surface energy, but preferably less than 75 mJ/m$^2$, more preferably less than 60, most preferably less than 45 mJ/m$^2$. The paper substrate may have a total surface energy that less than 75, 70, 65, 60, 55, 50, 45, 40, 35, 30, 25, 20, 15, 10, and 5 mJ/m$^2$, including any and all ranges and subranges therein. The total surface energy may further be at least 0.5, preferably at least 1, more preferably at least 2, and most preferably at least 5 mJ/m$^2$, including any and all ranges and subranges therein. Alternatively, the total surface energy may be at least 1, 2, 3, 4, 5, 6, 7, 8, 9, and 10 mJ/m$^2$, including any and all ranges and subranges therein.

The paper substrate may have any polar component of the total surface energy, but preferably less than 35 mJ/m$^2$, more preferably less than 20, most preferably less than 15 mJ/m$^2$. The paper substrate may have a polar component of the total surface energy that is less than 35, 30, 25, 20, 15, 10, 7 and 5 mJ/m$^2$, including any and all ranges and subranges therein. The any polar component may further be at least 0.5, preferably at least 1, more preferably at least 2, and most preferably at least 5 mJ/m$^2$, including any and all ranges and subranges therein. Alternatively, the any polar component may be at least 1, 2, 3, 4, 5, 6, 7, 8, 9, and 10 mJ/m$^2$, including any and all ranges and subranges therein.

The polar component may be any % of the total surface energy, preferably less than 50%, more preferably less than 30%, most preferably less than 15% of the total surface energy of the paper substrate. The polar component may be less than 50, 45, 40, 35, 30, 25, 20, 19, 18, 17, 16, 15, 10, and 5% of the total surface energy of the paper substrate, including any and all ranges and subranges therein.

The dispersive component may be any % of the total surface energy, preferably greater than 50%, more preferably more than 70%, most preferably more than 85% of the total surface energy of the paper substrate. The dispersive component may be at least 50, 55, 60, 65, 70, 75, 80, 85, 90, and 95% of the total surface energy of the paper substrate, including any and all ranges and subranges therein.

The paper substrate or article of the present invention may have at least one surface according to the total surface energy and/or polar and/or dispersive component embodiments as mentioned above.

The paper substrate and/or article may be single ply or a multilayered paper or paperboard material. Preferably, the substrate is multilayered. The paper substrate may have from 1 to 10, preferably from 1 to 7, most preferably from 1 to 5 layers containing cellulose fibers. The additional layers may be additional substrates described herein and/or bleached and/or unbleached substrates, such as kraft. Preferably, the substrate of the invention may include from 0 to 3 kraft layers having a any basis weight as mentioned above, preferably from 20 to 500 lbs/3000 square feet. These layers may be bleached or unbleached and may be at least one substrate of the present invention having any one or more embodiments discussed herein.

The layers may be glued, adhered and/or laminated together and/or to themselves.

The substrate of the present invention may be glued, adhered and/or laminated to itself or others like it or to conventional substrates. Preferably, the substrate contains an adhesive layer. The adhesive may be any adhesive. Examples of the adhesive are a hot melt adhesives although cold set adhesives may be used as well. A combination of cold set and hot melt adhesive may be used as well. Preferably, only hot-melt adhesive is utilized.

The paper substrate of the present invention may be used to form an article such as a bag. The bag may contain a plurality of paper substrates according to the invention and/or a single layer of the paper substrate that is folded upon itself and/or a single layer used in combination with at least one conventional substrate layer. Additional layers of kraft, conventional and/or modified as described herein as the invention, may be preferable.

When multiple layers are utilized and/or the paper substrate is folded upon itself, the layers and/or folds may be glued together. Preferably, the glue is an adhesive which is more preferably a hot melt adhesive. Examples of hot melt adhesives are those containing comprises a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer. Commercial hot melt adhesives include those from National Starch, Hercules, Henkel, Reynolds, Arizona Chemical Company, and HB Fuller.

While any adhesive may be utilized it is important that the adhesive have a total surface energy that is the sum of the polar component and the dispersive component. It is important that the polar component of the total surface energy of at least one surface of the paper substrate (with or without coating) be as close to equal to that of the polar component of the total surface energy of the adhesive. Preferably, the polar component of the total surface energy of at least one surface of the paper substrate (with or without coating) is from 1 to 1000%, more preferably 1 to 500%, most preferably from 1 to 200% that of the polar component of the total surface energy of the adhesive. This range includes 1, 2, 4, 5, 10, 15, 20, 25, 30, 35, 40, 45, 50, 55, 60, 65, 70, 75, 80, 85, 90, 95, 100, 105, 11, 120, 130, 140, 150, 160, 170, 180, 190, 200, 225, 250, 275, 300, 350, 400, 450, 500, 600, 700, 800, 900, and 1000% that of the polar component of the total surface energy of the adhesive, including any and all ranges and subranges therein.

The surface energy (polar, dispersive and/or total) of the paper substrate (with or without coating and/or wash layers) may be affected by the presence of the fluorine containing compound therein at the surface. One way to measure the amount of the fluorine containing compound at the surface of the paper substrate (including the surface of the coating and/or wash layer) is to measure the amount of fluorine present therein (preferably from 0.1 to 10 nm of a top surface of the coating) as measured by ESCA (electron spectroscopy chemical analysis and/or electron surface chemical analysis which is a standard test and discussed hereinbelow).

The surface of the substrate (including the surface of the coating and/or wash layer) may contain any amount of fluorine as measured by ESCA. It is preferable that the surface of the substrate (including the surface of the coating and/or wash layer) contain from 0.01 to 10,000% of fluorine within from 0.1 to 10 nm of a top surface (of the substrate, coating layer, and/or wash layer) as measured by ESCA (electron spectroscopy chemical analysis and/or electron surface chemical analysis) based upon the total amount of fluorine of the paper substrate. This range may include 0.01, 0.02, 0.05, 0.1, 1.0, 2.0, 5.0, 10, 20, 30, 40, 50, 60, 70, 80, 90, 100, 200, 300, 400, 500, 600, 700, 800, 900, 1000, 2000, 3000, 4000, 5000, 6000, 7000, 8000, 9000, and 10000% based upon the total amount of fluorine of the paper substrate including any and all ranges and subranges therein.

Alternatively, it is preferable that the surface of the substrate (including the surface of the coating and/or wash layer) contain from 0.0001 to 10 wt % of fluorine within from 0.1 to 10 nm of a top surface (of the substrate, coating layer, and/or wash layer) as measured by ESCA (electron spectroscopy chemical analysis and/or electron surface chemical analysis) based upon the total weight of the paper substrate. This range may include 0.0001, 0.0002, 0.0005, 0.001, 0.002, 0.005, 0.01, 0.02, 0.05, 0.1, 0.2, 0.5, 1, 2.0, 5.0, and 10 wt % based upon the total weight of the paper substrate including any and all ranges and subranges therein.

The article of the present invention may preferably contain the substrate of the present invention, as well as additional layers. The additional layers may each themselves contain polymer, laminate, polypropylene, high density and low density polyethylene, and nylon for example.

The substrate or article of the present invention may have any gloss as measured by TAPPI Standard 75° Test. Preferably, the substrate has a TAPPI 75° gloss value that is at least 50% at 75°, more preferably at least 55%, most preferably at least 60% as measured by the TAPPI Standard 75° test. The substrate or article may have a TAPPI 75° gloss value that is preferably not more than 100%, more preferably not more than 85%, most preferably not more than 75%. The substrate or article may have a TAPPI 75° gloss value that is 50, 55, 60, 61, 62, 63, 64, 65, 66, 67, 68, 69, 70, 71, 72, 73, 74, 75, 80, 85, 90, 95, and 100%, including any and all ranges and subranges therein.

The paper substrate or article has any MD internal bond, but preferably has a MD internal bond of from 10 to 350 ft-lbs$\times10^{-3}$/in$^2$, preferably from 10 to 140 ft-lbs$\times10^{-3}$/in$^2$, more preferably from 10 to 90 ft-lbs$\times10^{-3}$/in$^2$, most preferably from 10 to 60 ft-lbs$\times10^{-3}$/in$^2$. This range includes 10, 11, 12, 13, 14, 15, 20, 25, 30, 35, 40, 45, 50, 55, 60, 65, 70, 75, 80, 85, 90, 95, 100, 105, 110, 115, 120, 125, 130, 135, 140, 145, 150, 160, 165, 170, 175, 180, 185, 190, 195, 200, 210, 220, 230, 240, 250, 260, 270, 280, 290, 300, 310, 320, 330, 340, and 350 ft-lbs$\times10^{-3}$/in$^2$, including any and all ranges and subranges therein. The MD internal bond is Scott Bond as measured by test TAPPI t-569.

The paper substrate or article may have any CD internal bond, but preferably has a CD internal bond of from 10 to 350 ft-lbs$\times10^{-3}$/in$^2$, preferably from 10 to 140 ft-lbs$\times10^{-3}$/in$^2$, more preferably from 10 to 90 ft-lbs$\times10^{-3}$/in$^2$, most preferably from 10 to 60 ft-lbs$\times10^{-3}$/in$^2$. This range includes 10, 11, 12, 13, 14, 15, 20, 25, 30, 35, 40, 45, 50, 55, 60, 65, 70, 75, 80, 85, 90, 95, 100, 105, 110, 115, 120, 125, 130, 135, 140, 145, 150, 160, 165, 170, 175, 180, 185, 190, 195, 200, 210, 220, 230, 240, 250, 260, 270, 280, 290, 300, 310, 320, 330, 340, and 350 ft-lbs$\times10^{-3}$/in$^2$, including any and all ranges and subranges therein. The CD internal bond is Scott Bond as measured by test TAPPI t-569.

Both of the above-mentioned CD and MD internal bond as measured by Scott Bond test TAPPI t-569 may also be measured in J/m$^2$. The conversion factor to convert ft-lbs$\times10^{-3}$/in$^2$ to J/m$^2$ is 2. Therefore, to convert an internal bond of 100 ft-lbs$\times10^{-3}$/in$^2$ to J/m$^2$, simply multiply by 2 (i.e. 100 ft-lbs$\times10^{-3}$/in$^2\times2$ J/m$^2$/1 ft-lbs$\times10^{-3}$/in$^2$=200 J/m$^2$. All of the above-mentioned ranges in ft-lbs$\times10^{-3}$/in$^2$, therefore, may then include the corresponding ranges for internal bonds in J/m$^2$ as follows.

The paper substrate or article preferably has a MD internal bond of from 20 to 700 J/m$^2$, preferably from 20 to 280 J/m$^2$, more preferably from 200 to 1800 J/m$^2$, most preferably from 20 to 120 J/m$^2$. This range includes 20, 22, 24, 26, 28, 30, 40, 50, 60, 70, 80, 90, 100, 110, 120, 130, 140, 150, 160, 170, 180, 190, 200, 210, 220, 230, 240, 250, 260, 270, 280, 290, 300, 320, 330, 340, 350, 360, 370, 380, 390, 400, 420, 440, 460, 480, 500, 520, 540, 560, 580, 600, 620, 640, 660, 680, and 700 J/m$^2$, including any and all ranges and subranges therein. The MD internal bond is Scott Bond as measured by test TAPPI t-569.

The paper substrate or article preferably has a CD internal bond of from 20 to 700 J/m$^2$, preferably from 20 to 280 J/m$^2$, more preferably from 200 to 1800 J/m$^2$, most preferably from 20 to 120 J/m$^2$. This range includes 20, 22, 24, 26, 28, 30, 40, 50, 60, 70, 80, 90, 100, 110, 120, 130, 140, 150, 160, 170, 180, 190, 200, 210, 220, 230, 240, 250, 260, 270, 280, 290, 300, 320, 330, 340, 350, 360, 370, 380, 390, 400, 420, 440, 460, 480, 500, 520, 540, 560, 580, 600, 620, 640, 660, 680, and 700 J/m$^2$, including any and all ranges and subranges therein. The CD internal bond is Scott Bond as measured by test TAPPI t-569.

The paper substrate or article of the present invention may have any Parker Print Smoothness (10 kgf/cm$^2$), but preferably has a Parker Print Smoothness that is less than or equal to 2, preferably after calendaring and/or supercalendering, more preferably less than 1.5, most preferably less than 1.2, and even most preferably from about 0.5 to 1.5 as measured by TAPPI test method T 555 om-99. The Parker Print Smoothness of the paper substrate or article may be less than 2, 1.9, 1.8, 1.7, 1.6, 1.5, 1.4, 1.3, 1.2, and 1.1, including any and all ranges and subranges therein. The Parker Print Smoothness of the paper substrate or article may be at least 0.5, 0.6, 0.7, 0.8, and 0.9 2, 1.9, 1.8, 1.7, 1.6, 1.5, 1.4, 1.3, 1.2, and 1.1, including any and all ranges and subranges therein. Most preferably, the Parker Print Smoothness may be about 1.

The paper substrate or article of the present invention may have any moisture, preferably after calendaring and/or supercalendering, but preferably has a moisture content that is from 4% to 7%, more preferably from 4.5% to 6.5%, most preferably from 5% to 6%. The moisture may be 4, 4.5, 5, 5.5, 6, 6.5, and 7%, including any and all ranges and subranges therein. Most preferably, the moisture may be about 5.5%.

In one embodiment, the substrate or article has a moisture content of between 5 and 6% while maintaining at least one Parker Print Surface that is less than or equal to about 1.2.

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

All of the references, as well as their cited references, cited herein are hereby incorporated by reference with respect to relative portions related to the subject matter of the present invention and all of its embodiments

EXAMPLES

A trial on 55 lb paper substrates (weight includes weight of coating and wash layers) was conducted using Solvay Solexis' Solvera 5071 fluorocarbon at the size press. Three reels (controls 1; 2; and 3) of untreated substrate were run along with 4 additional reels: 2 at 3.5 #/ton of paper of the fluorocarbon (Exp 1 and 2) and 2 rolls at 4.5 #/ton or paper of the fluorocarbon (Exp 3 and 4).

In a standard papermaking machine, the above substrates were made using the below adjustments:

Size Press

1. Double dose of defoamer in the starch coming from Chem Prep. We will be using Nalco's antifoam 7565 in starch as an anti-foam.
   - First night set up one tote of PT5071 fluorocarbon to pump through the fluorocarbon line.
   - Kept uncoated broke at a minimum of 6%.
   - Kept ash target to 3%. Add Albacar to both the MC and PCP.
   - Flow rate of 2050 mL/min (~3.5 #/ton, 0.54 gpm) of the Solvay 5071 and Nalkat 2020 flow rate at 524 mL/min (~for the first 2 experimental reels and 2558 mL/min (~4.5 #/ton, 0.70 gpm) of the Solvay 5071 and Nalkat 2020 flow rate at 673 mL/min for the last 2 experimental reels.
   - Keep starch pick-up to 20 Mon.

Coatings (Coating Layer and Wash Layer)

- Prepared titanium.
- See attached coating formulations for backwash and coating.
- Did not add defoamer to coating or backwash.
- Backwash Formulation
- Added 40 parts of clay and 60 parts of Hydrocarb 90.
- Added 15 parts of latex. Use Dow RAP 527.
- Added 156 parts of starch.
  - Ran normal coating formulation with Dow RAP 527.
- Pigment package=67 parts clay; 8 parts titanium dioxide, 20 parts calcium carbonate, 5 parts plastic pigment,
- Binder package=3.5 parts resin (starch solubilizer); 2 parts latex, 1 part calcium stearate, <1 part viscosity modifier (Admiral 3089); <1 part dispersant (Olloid 211)
- Tinted dye package=90 mLs of Irgalite RL blue dye per 800 gallons of coating formulation and 70 mLs of Violet B New per 800 gallons of coating formulation.

RESULTS gloss was about 66, parker print was about 1.0, moisture off the supercalender stack was about 5.5% and Scott Internal bond was about 120.

Run temperature was at 180 degrees.

Measurement of Surface Energy and Polar and Dispersive Components for Paper and Adhesive Samples Surface energies for the paper samples were determined using the Fowkes theory (Fowkes, F. M., *Industrial and Engineering Chemistry,* 56, 12, 40, (1964)), which describes the surface energy of a solid surface as having a polar and a dispersive component, the sum of which is the total surface energy. The surface energy is calculated based upon the interaction of two probe liquids with the paper surface. In this case, contact angles were measured for water and diiodomethane as the probe liquids. The contact angle was measured at 1.0 seconds after the drop placement, and 10 drops of each probe liquid were used to compute an average initial contact angle. Percent polarity is calculated as the percentage contribution of the polar component of the total surface energy (polar plus dispersive components.)

Surface Energies Determined - arranged in order of increasing surface energy

| Surface | Overall Surface Energy (mJ/m2) | Polar Comp. (mJ/m2) | Disperse Comp. (%) | Surface Polarity |
|---|---|---|---|---|
| control 1 | 41.76 | 3.33 | 38.43 | 7.97 |
| control 2 | 41.85 | 3.47 | 38.38 | 8.3 |
| EXP1 | 44.05 | 6.24 | 37.81 | 14.17 |
| EXP2 | 42.78 | 4.61 | 38.17 | 10.78 |
| EXP3 | 44.39 | 6.74 | 37.65 | 15.18 |
| EXP4 | 44.43 | 6.78 | 37.65 | 15.26 |

HOT MELT SURFACE TENSION AND CHEMICAL CHARACTERIZATION
Surface Tension of Hot Melt Adhesives (in order of increasing energy) at 350 F.

| Manufacturer | Product | Chemical Type | Overall Surface Tension (mJ/m2) | Polar Comp. (mJ/m2) | Disperse Comp. (mJ/m2) | Surface Polarity (%) |
|---|---|---|---|---|---|---|
| Reynolds | X52-824 UV | PE | 28.91 | 3.85 | 25.06 | 13.30 |
| HB Fuller | HL 2866M | Polyamide | 30.31 | 0.97 | 29.34 | 3.19 |
| HB Fuller | HL 0863 | | 31.02 | 1.32 | 29.70 | 4.24 |
| HB Fuller | HL 0008 | PE | 32.01 | 1.93 | 30.08 | 6.02 |
| HB Fuller | HL 0757 | EVAc, PE | 32.59 | 2.14 | 30.45 | 6.56 |
| HB Fuller | HM 2659 | Polyamide | 34.20 | 3.51 | 30.69 | 10.26 |
| Henkel | 80-8278 | PE | 35.75 | 4.56 | 31.19 | 12.76 |

- Kept viscosity of coating above 1400 cp.
- backwash coat weight was 4 lbs/ton of paper.
- Coating layer coat weight was 8 lbs and did not contain fluorocarbon because fluorocarbon was added at the size press.
- Monitor backwash level in run tank to keep from overflowing.
- coater moisture was 6.7%.
- basis weight was 50.2 lbs/ton.

X-Ray Photoelectron Spectroscopy (XPS) or Electron Spectroscopy for Chemical Analysis (ESCA)

In XPS, x-rays strike atoms, displacing inner-shell electrons, producing photoelectrons whose energy is measured and is characteristic for a particular chemical element. The depth of analysis is limited by the ejected electrons which are quickly "quenched" by atomic layers, hence XPS is extremely surface-sensitive, with signals generally restricted to a penetration depth of less than 10 nm.

Specimens were prepared by mounting paper on a 3 mm stub using conductive carbon tape and the excess paper trimmed away.

The x-rays were generated from a magnesium source at 12 KeV and 20 mA. Preset scan rates for carbon and fluorine were used with 300 ms/step dwell. In order to reach deeper layers, material was etched away. Etching was achieved using a high speed argon gun powered to 0.5 KeV with 50 mA current. Samples were etched for 10 seconds to an approximate depth of 10 nm (referenced to the tantalum oxide/tantalum metal model system).

Test results are expressed as % of the stained surface.

Any results below 2% stained surface is regarded as positive.

Note: Similar testing is performed on flat test paper specimens with less than 0.5% regarded as positive result.

See FIG. 1 for details of test set-up.

Aggressive Pet Food Test

This test is useful to measure the ability of paper or paperboard to prevent staining by pet-food materials. Commercial pet-food material is used to simulate real conditions of use. Low fat (8 to 11% wt. crude fats), dry pet-food material is used to test board samples, while high-fat (15 to 23% wt. crude fat), moist pet food material is used to test paper samples, to be used as inner/outer ply in pet-food bag constructions.

ESCA (Electron Surface Chemical Analysis)

| Sample ID | Solvay PT5071 Added Lb/ton | Kit Flat | Kit Creased | Creased RP2 | Creased AGR | % Fluorine | ESCA Non-Etched Shiny C 1s | ESCA Non-Etched Dull C 1s 1 | ESCA Non-Etched Dull C 1s | ESCA Non-Etched Dull F 1s | Fluorine Ratio Surface to Overall | ESCA Etched (10 seconds) Shiny C 1s | ESCA Etched (10 seconds) Dull C 1s 1 | ESCA Etched (10 seconds) Dull C 1s 2 | ESCA Etched (10 seconds) Dull C 1s | ESCA Etched (10 seconds) Dull F 1s |
|---|---|---|---|---|---|---|---|---|---|---|---|---|---|---|---|---|
| control 1 A | | | | | | | 100 | 45.25 | 44.12 | 10.63 | | 100 | 56.82 | 36.09 | 7.09 | None |
| control 2 B | | | | | | | 100 | 45.44 | 44.46 | 10.09 | | 100 | 56.07 | 34.64 | 9.28 | None |
| exp 4 C | 4.5 | 8 | 7 | 0.50% | 0.70% | 0.121% | 100 | 47.66 | 42.61 | 9.73 | 8041 | 100 | 57.05 | 33.64 | 9.31 | None |
| exp 3 D | 4.5 | 8 | 6.5 | 0.20% | 0.30% | 0.081% | 100 | 44.55 | 42.85 | 12.61 | 15568 | 100 | 56.22 | 34.6 | 9.18 | None |
| exp 2 E | 3.5 | 7 | 6.5 | 0.30% | 0.40% | 0.062% | 100 | 49.85 | 44.72 | 5.44 | 8774 | 100 | 56.79 | 34.56 | 8.65 | None |
| exp 1 F | 3.5 | 7 | 6 | 2.50% | 1.00% | 0.064% | 100 | 48.41 | 44.14 | 7.45 | 11641 | 100 | 54.67 | 36.04 | 9.3 | None |

Ralston Purina (RP-2) Test

This well-known test has been proposed by the Ralston-Purina company. This test is useful to characterize grease resistance properties of pet-food paper, intended to be used for not aggressive oils packaging conditions.

A detailed test procedure can be obtained from Ralston-Purina Company.

Materials:

- Ralston Purina Oil
- Smooth Roller of 4.5 lb with external rubber surface.
- Oven, able to keep a 60° C.±1° C. (140±1° F.) temperature, with 50% R.H.
- Metal rings, internal diameter 3 inches, height minimum ½ inches and 1/16 inch in thickness.
- Tube of 1 inch internal diameter and 1 inch in height.
- Ottawa sand 20/30 mesh.
- Pipette calibrated to deliver 1.3 cc of oil.
- Weighing balance Procedure:

- Multiple test paper specimens are creased along the diagonals using a smooth roller of 4.5 lb with an external rubber surface.
- The paper specimen is placed on a coated grid printed sheet, which is in turn placed on metal plate.
- Place a metal ring of 3 inch diameter on the surface of the paper.
- About 5 gm of Ottawa Sand pile is placed onto the paper, with the test side facing up (typically felt side) using a tube with 1 inch internal diameter.
- The sand is saturated with 1.3 cc of proprietary Ralston Purina red stained oil. The construction is kept in oven at 60° C./140° F. for 24 hours.

Materials

- Pet-food pellets (any commercial material, with crude fat content from 10% to 23%)
- Oven, able to keep a 60° C.±1° C. (140±1° F.) temperature, with 50% R.H.
- Metal rings, internal diameter 3 inches, height minimum 2 inches.
- Metal weights, cylindrical with base diameter 3 inches, 3.30 lb weight
- Weighing balance Procedure for fluorochemical treated paper

- Cut 10*10 cm paper specimen.
- Crease the paper specimen along the diagonals, using a smooth roller 4.5 lb with an external rubber surface.
- Place paper test specimen on a grid printed sheet placed on metal plate.
- Place the metal ring centered onto the paper specimen.
- Fill the metal ring with 60 grams grinded pet food material.
- Place the weight on the pet-food.
- Store in oven at 60° C./140° F. for 24 hours.
- After the test is completed remove the weights and the pet-food, and inspect the grid printed sheet for staining.

Procedure for Fluorochemical Treated Paper Board

Use the same procedure as above but fill the metal ring with 40 grams, dry pet-food pellets. After the test time is elapsed, remove the weights and the pet-food, and inspect the top side of the board for staining.

Results

Test results for paper are expressed as % of stained surface. Any staining below 2% should be regarded as positive. Test results for board samples are expressed as % of stained surface on the board top side.

Figure 2:
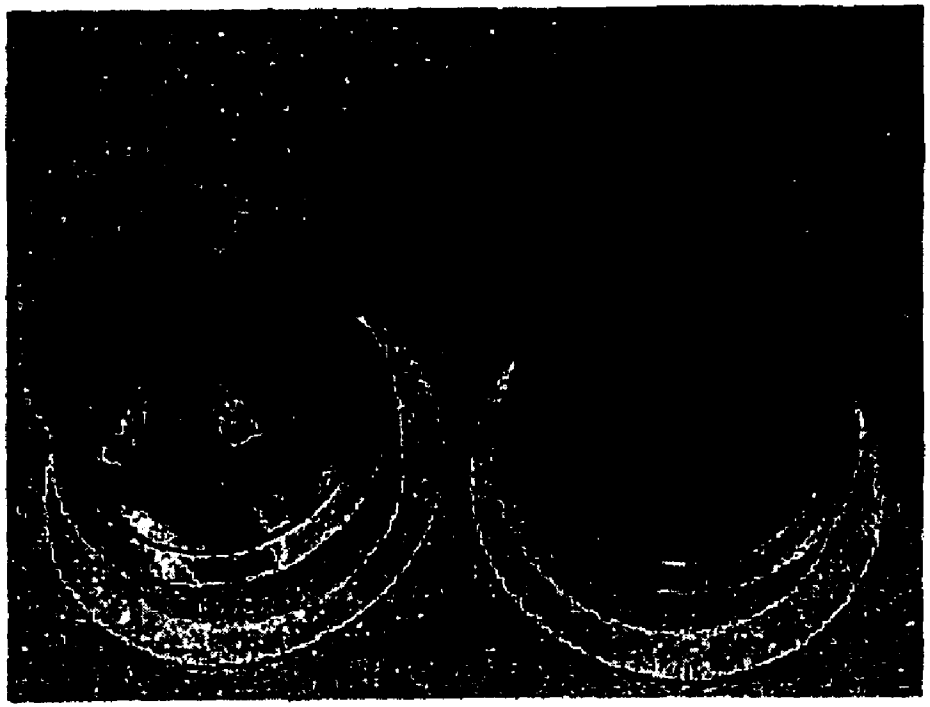
FIG. 2: Provides a detailed view of the Aggressive Pet Food Test equipment.

See FIG. 2 for a picture of the test equipment.

What is claimed is:

1. A paper substrate, comprising:

a web of cellulose fibers;

a size-press applied layer in contact with at least a portion of said web of cellulose fibers, said size-press layer comprising a fluorocarbon-containing compound;

at least one coating layer in contact with one or both of said web of cellulose fibers and said size-press applied layer, and a wash coat layer, wherein said at least one coating layer comprises from 0.5 to 50 parts starch and greater than 40 parts clay, wherein said fluorocarbon-containing compound interpenetrates said web of cellulose fibers in an amount from 0.5 to 100% based upon the thickness of said size-press layer, and wherein said fluorocarbon-containing compound is not present in said at least one coating layer.

2. The paper substrate according to claim 1, comprising from 0.5 to 10 lbs fluorocarbon-containing compound/ton of paper substrate.

3. The paper substrate according to claim 1, comprising from 2 to 6 lbs fluorocarbon-containing compound/ton of paper substrate.

4. The paper substrate according to claim 1, comprising from 3 to 5 lbs fluorocarbon-containing compound/ton of paper substrate.

5. The paper substrate according to claim 1, wherein the concentration of the fluorocarbon-containing compound increases as one approaches the surface of the web.

6. The paper substrate according to claim 1, wherein the coating layer comprises from 0.01 to 10,000% of fluorine within from 0.1 to 10 nm of a top surface of the coating as measured by ESCA (electron spectroscopy chemical analysis and/or electron surface chemical analysis) based upon the total amount of fluorine in the paper substrate.

7. The paper substrate according to claim 1, further comprising a plurality of layers, each comprising a web of cellulose fibers.

8. The paper substrate according to claim 1, further comprising a layer of unbleached kraft paper.

9. The paper substrate according to claim 1, wherein the fluorocarbon-containing compound is a perfluorinated polymer, perfluorinated copolymer, perfluoropolyether, or derivatives thereof.

10. The paper substrate according to claim 1, wherein the fluorocarbon-containing compound is a perfluoropolyether or salt thereof.

11. The paper substrate according to claim 1, wherein the fluorocarbon-containing compound is a perfluoropolyether ammonium salt.

12. The paper substrate according to claim 1, wherein a surface of the substrate has a first total surface energy that is less than 75 $mJ/m^2$.

13. The paper substrate according to claim 1, wherein a surface of the substrate has a first total surface energy that is the first sum of a first polar component and a first dispersive component, and wherein said first polar component is less than 30% of said first total surface energy.

14. The paper substrate according to claim 1, wherein a surface of the substrate has a first total surface energy that is the first sum of a first polar component and a first dispersive component, and wherein the first polar component is less than 20 $mJ/m^2$ of said first total surface energy.

15. The paper substrate according to claim 1, further comprising an adhesive layer.

16. The paper substrate according to claim 15, wherein the adhesive layer comprises a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

17. The paper substrate according to claim 1, wherein the wash layer comprises more than 50 parts starch and less than 100 parts clay.

18. An article comprising the paper substrate according to claim 1.

19. The article of claim 18, wherein said article is a bag.

20. The article according to claim 18, wherein said article is a food-containing bag.

21. The article according to claim 18, further comprising a grease-containing product.

22. The paper substrate according to claim 1, wherein the coating layer comprises from 0.001 to 10,000 wt % of fluorine within from 0.1 to 10 nm of a top surface of the coating as measured by ESCA (electron spectroscopy chemical analysis and/or electron surface chemical analysis) based upon the total weight of the paper substrate.

23. The paper substrate of claim 15, wherein said surface has a first total surface energy that is a sum of a first polar component and a first dispersive component, wherein said adhesive has a second total surface energy that is the sum of a second polar component and a second dispersive component, and wherein said first polar component of said first total surface energy is from 1 to 200% of said second polar component of said second total surface energy.

24. A multi-layered paper substrate, comprising:

a plurality of layers, each layer having a web of cellulose fibers; wherein at least one of said plurality of layers further comprises a size-press applied layer in contact with at least a portion of said web of cellulose fibers, said size-press layer comprising a fluorocarbon-containing compound; and at least one coating layer in contact with one or both of said web of cellulose fibers and said size-press applied layer, wherein said at least one coating layer comprises from 0.5 to 50 parts starch and greater than 40 parts clay, wherein said fluorocarbon-containing compound interpenetrates said web of cellulose fibers in an amount from 0.5 to 100% based upon the thickness of said size-press layer, and wherein said fluorocarbon-containing compound is not present in said at least one coating layer.

25. The paper substrate according to claim 24, wherein at least one of said plurality of layers is unbleached kraft paper.

26. The paper substrate according to claim 24, comprising from 0.5 to 10 lbs fluorocarbon-containing compound/ton of paper substrate.

27. The paper substrate according to claim 24, comprising from 2 to 6 lbs fluorocarbon-containing compound/ton of paper substrate.

28. The paper substrate according to claim 24, comprising from 3 to 5 lbs fluorocarbon-containing compound/ton of paper substrate.

29. The paper substrate according to claim 24, wherein the fluorocarbon-containing compound is a perfluorinated polymer, perfluorinated copolymer, perfluoropolyether, or derivatives thereof.

30. The paper substrate according to claim 24, wherein the fluorocarbon-containing compound is a perfluoropolyether or salt thereof.

31. The paper substrate according to claim 24, wherein the fluorocarbon-containing compound is a perfluoropolyether ammonium salt.

32. The paper substrate according to claim 24, further comprising an adhesive layer.

33. The paper substrate according to claim 32, wherein the adhesive layer comprises a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

34. An article comprising the paper substrate according to claim 24.

35. The article of claim 34, wherein said article is a bag.

36. The article according to claim 34, wherein said article is a food-containing bag.

37. A paper substrate, comprising:

a web of cellulose fibers;

a size-press applied layer in contact with at least a portion of said web of cellulose fibers, said size-press layer comprising a fluorocarbon-containing compound; and at least one coating layer in contact with one or both of said web of cellulose fibers and said size-press applied layer, wherein said at least one coating layer comprises from 0.5 to 50 parts starch and greater than 40 parts clay, wherein said fluorocarbon-containing compound interpenetrates said web of cellulose fibers in an amount from 0.5 to 100% based upon the thickness of said size-press layer, wherein said fluorocarbon-containing compound is not present in said at least one coating layer, and wherein the fluorocarbon-containing compound is a perfluoropolyether or salt thereof.

38. The paper substrate according to claim 37, wherein the fluorocarbon-containing compound is a perfluoropolyether ammonium salt.

39. The paper substrate according to claim 37, comprising from 0.5 to 10 lbs fluorocarbon-containing compound/ton of paper substrate.

40. The paper substrate according to claim 37, comprising from 2 to 6 lbs fluorocarbon-containing compound/ton of paper substrate.

41. The paper substrate according to claim 37, comprising from 3 to 5 lbs fluorocarbon-containing compound/ton of paper substrate.

42. The paper substrate according to claim 37, further comprising an adhesive layer.

43. The paper substrate according to claim 42, wherein the adhesive layer comprises a polyamide, polyamide containing polymer, polyamide containing copolymer, polyethylene, polyethylene-containing polymer, polyethylene-containing copolymer, ethylene vinyl acetate, ethylene vinyl acetate-containing polymer, ethylene vinyl acetate copolymer, vinyl, polyvinyl, vinyl containing polymer, vinyl containing copolymer, poly, alpha olefin, olefin, polyolefin, olefin containing polymer, and olefin containing copolymer.

44. An article comprising the paper substrate according to claim 37.

45. The article of claim 44, wherein said article is a bag.

46. The article according to claim 44, wherein said article is a food-containing bag.

* * * * *